US011958097B2

(12) United States Patent
Paulsen et al.

(10) Patent No.: US 11,958,097 B2
(45) Date of Patent: Apr. 16, 2024

(54) METHOD FOR CALIBRATING A METAL PROFILE BLANK WHICH IS CONFIGURED AS A HOLLOW-CHAMBER PROFILE AND WHICH HAS AT LEAST ONE SOLID WALL

(71) Applicant: BENTELER AUTOMOBILTECHNIK GMBH, Paderborn (DE)

(72) Inventors: Frode Paulsen, Gjovik (NO); Christian Handing, Langenberg (DE)

(73) Assignee: BENTELER AUTOMOBILTECHNIK GMBH, Paderborn (DE)

( * ) Notice: Subject to any disclaimer, the term of this patent is extended or adjusted under 35 U.S.C. 154(b) by 0 days.

(21) Appl. No.: 17/461,170

(22) Filed: Aug. 30, 2021

(65) Prior Publication Data

US 2022/0062965 A1 Mar. 3, 2022

(30) Foreign Application Priority Data

Aug. 31, 2020 (DE) ..... 102020122711.6

(51) Int. Cl.
*B21D 3/10* (2006.01)
*B21D 5/00* (2006.01)

(52) U.S. Cl.
CPC ..... *B21D 5/004* (2013.01); *B21D 3/10* (2013.01)

(58) Field of Classification Search
CPC ..... B21C 37/30; B21C 35/03; B21D 3/10; B21D 3/14; B21D 1/08
See application file for complete search history.

(56) References Cited

U.S. PATENT DOCUMENTS

2010/0024503 A1 2/2010 Bradley et al.
2019/0091745 A1* 3/2019 Gotthelf ..... B21D 37/10

FOREIGN PATENT DOCUMENTS

| | | | | |
|---|---|---|---|---|
| CN | 109175014 A | * | 1/2019 | ..... B21D 3/05 |
| CN | 110449490 | | 11/2019 | |
| DE | 102005020727 | | 11/2006 | |
| DE | 102014004183 | | 9/2014 | |
| DE | 102014004329 | | 10/2015 | |
| DE | 102015006669 | | 4/2018 | |

(Continued)

OTHER PUBLICATIONS

Extended European Search Report for Europe Patent Application No. 21190565.8, dated Jan. 27, 2022, 10 pages.

*Primary Examiner* — Debra M Sullivan
(74) *Attorney, Agent, or Firm* — SHERIDAN ROSS P.C.

(57) ABSTRACT

A method for calibrating a metal profile blank configured as a hollow-chamber profile having at least one solid wall. A pressing tool is closed in a main direction about one end region of an element of the profile blank until surfaces of the pressing tool lie against a pair of surfaces of the profile blank to be calibrated, deforming and bending the at least one end region of the element. The pressing tool is closed in a secondary direction perpendicular to the main direction until surfaces of the pressing tool lie against surfaces of the at least one end region, and wedge-like limbs of a drive element of the pressing tool engage wedge-like dies of the pressing tool. The pressing tool is closed further in the secondary direction, subjecting the profile blank to plastic deformation so as to reduce or eliminate the bending of the end region.

9 Claims, 6 Drawing Sheets

(56) References Cited

FOREIGN PATENT DOCUMENTS

| | | |
|---|---|---|
| DE | 102017008907 | 3/2019 |
| DE | 102018124982 | 4/2020 |
| DE | 102018131967 | 6/2020 |
| EP | 1285705 | 2/2003 |

* cited by examiner

METHOD FOR CALIBRATING A METAL PROFILE BLANK WHICH IS CONFIGURED AS A HOLLOW-CHAMBER PROFILE AND WHICH HAS AT LEAST ONE SOLID WALL

CROSS-REFERENCE TO RELATED APPLICATION

This application claims the benefit of German Patent Application No. 10 2020 122 711.6, filed Aug. 31, 2020, the entire contents of which are incorporated herein by reference.

FIELD

The invention relates to a method for calibrating a metal profile blank which is configured as a hollow-chamber profile and which has at least one solid wall. Furthermore, the invention relates to a pressing tool for calibration of a profile blank according to the invention by a method according to the invention.

BACKGROUND

At present, in automotive construction and engineering, many applications use profiles, in particular also hollow-chamber profiles composed of aluminum or steel alloys as material for bases and walls, which have to be joined to one another. In this case, for example an interior space for receiving batteries or the like and more can be provided. Here, the interior space is closed in a fluid-tight manner by a cover and a seal. The base and the walls composed of one or more respective profiles are also joined to one another in a fluid-tight manner, for example by friction stir welding or cold pressure joining.

Owing to the large dimensions of the containers of in some instances several square meters, the manufacture of profiles for applications of this kind gives rise to the challenge that production tolerances of the profiles, in particular wall thicknesses, outer dimensions and the like, from an extrusion process or in the case of steel materials also from the roll-forming process are relatively large, and therefore coupling of the individual parts to one another or the joining thereof is made more difficult. As a result, the large tolerances are reduced or compensated by time-intensive and cost-intensive machining of the joining regions, particularly in the case of frame profiles configured as hollow-chamber profiles. In this case, the required oversize of the profiles also involves a higher overall weight, since the wall thickness has to be selected to be higher than necessary for the operational stability. This is questionable both from an economical and ecological standpoint. Alternatively, it is also known that, in particular prior to the joining, the profiles are oriented relative to one another in a clamping device and positioned in the joining position and then joined. However, a disadvantage here is the introduction of high residual stresses, which may have an adverse effect on the service life and crash properties of the parts produced in this way, for example of a battery container.

In many cases, it is also necessary to arrange tolerance compensating elements on such profiles to be joined to one another, in order to connect the profiles which are joined in a less dimensionally accurate manner to inner transverse walls or inner longitudinal walls, for example.

EP 1 285 705 A2 discloses for example a hollow-chamber profile in which a hollow chamber is widened by pulling a mandrel through it, as a result of which the surfaces of the hollow-chamber profile are defined and said hollow-chamber profile is thus calibrated in a simple manner. In principle, hollow-chamber profiles can very readily be calibrated using widening methods of this kind. However, the instrument-related and method-related effort is relatively great and complex, since the mandrels which are used for widening the hollow-chamber profile have to be adapted to the respective hollow chamber of the hollow-chamber profile in a very precise manner. In this case, it must be borne in mind that the mandrel has to both engage correspondingly on the hollow chamber of the hollow-chamber profile at the beginning of the widening operation and ensure that the exact and calibrated shape of the hollow-chamber profile is set at the end of the calibration operation.

A similar method is described in DE 10 2014 004 183 A1. In this case, a hollow-chamber profile is calibrated by means of internal high pressure forming.

DE 10 2017 008 907 A1 also describes a method in which inner mandrels are used to widen the end regions of a hollow-chamber profile.

DE 10 2005 020 727 A1 describes a multi-chamber tube which is configured as a heat exchanger and in which inner webs are compressed and deformed.

SUMMARY

It is therefore an object of the invention to provide a method for calibrating a metal profile blank which has at least one solid wall, in which method tools for calibration which are costly and time-consuming in terms of method do not have to be produced, it being possible to calibrate both plate-like profile blanks and hollow-chamber profile blanks. It is also an object of the invention to provide corresponding profiles and a corresponding tool.

With regard to the method, this object is achieved by a method for calibrating a metal profile blank which has at least one solid wall, having all the method steps of patent claim 1. Advantageous embodiments of the method can be found in subclaims 2 to 9. With regard to the profile, the object is achieved by a profile having all the features of patent claims 10 and 11. With regard to the tool, the object is achieved by a pressing tool for calibration of a profile blank, having all the features of patent claim 12.

The method according to the invention for calibrating an extruded metal profile blank which is configured as a hollow-chamber profile and which has at least one solid wall is distinguished by the following method steps:

a) providing a metal profile blank which is configured as a hollow-chamber profile and which has at least one—in particular plate-like—element with a longitudinal extent, a transverse extent and a vertical extent, b) inserting at least one end region of the element of the profile blank into a cavity of an open pressing tool, c) closing the pressing tool in such a way that surfaces of the pressing tool are displaced in a main closing direction perpendicular to the longitudinal extent of the profile blank until they come to lie against a pair of surfaces, which are situated opposite one another at a distance, of the at least one end region of the element of the profile blank to be calibrated, d) closing the pressing tool further in the main direction, compression having the effect that the at least one end region of the element of the profile blank is deformed and the plate-like element of the profile blank is bent, e) closing the pressing tool in a secondary direction perpendicular to the main direction and to the longitudinal extent of the profile blank until surfaces of the pressing tool come to lie against surfaces of the at least one end region of the element of the profile blank to be calibrated, wedge-like limbs of a drive element of the pressing tool coming into engagement with wedge-like dies of the pressing tool and the wedge-like limbs being supported in this case on supporting or mating elements, a floating mandrel being inserted into at least one hollow chamber of the profile blank, f) closing the pressing tool further in the secondary direction, the moving of the wedge-like limbs of the drive element of the pressing tool against the wedge-like dies of the pressing tool having the effect that the profile blank is subjected to plastic deformation, generated as a result of compression, in the main or secondary direction so as to reduce or eliminate the bending generated in step d), g) opening the pressing tool, h) removing the profile blank which has now been calibrated to the final profile.

It should be noted here that the chronological sequence of the individual method steps a) to h) represents a particularly advantageous embodiment of the invention. However, the invention is not restricted thereto. Rather, it is for example also possible according to the invention to allow method steps c) and e) or else d) and f) to take place at the same time.

The method according to the invention makes it possible in a simple manner to calibrate, in particular in the end regions thereof, a wide variety of different extruded metal profile blanks which are configured as hollow-chamber profiles, in order to compensate for connection tolerances and to enable joining to other components by way of the finally calibrated profiles.

In this case, the profile blank has at least one—in particular but not necessarily plate-like—element with a longitudinal extent, a transverse extent and a vertical extent. Due to plastic deformation of the element both in the main and in the secondary direction, the element is correspondingly calibrated, in which case expansion of the plate-like element in a longitudinal direction may also occur, which can however already be taken into consideration during the production of the profile blank. It is essential here that the element is compressed and plastically deformed in the main and secondary directions, said element being subjected to bending in the secondary direction at the same time. This bending is removed again by final compression or plastic deformation. After the profile blank according to aforementioned embodiments has been calibrated to the final profile, the pressing tool is opened and the profile is removed from the pressing tool.

In principle, the invention has the advantage that the profile blanks can be produced with minimal weight, since no machining steps whatsoever are required for the calibration.

What is achieved in a simple manner by the use of wedge-like limbs of a drive element of the pressing tool which come into engagement with, and slide on, wedge-like dies of the pressing tool, the wedge-like limbs also being supported on supporting or mating elements, and also by the floating mandrel inserted in the at least one hollow chamber, is that the wedge-like limbs move in the secondary direction perpendicularly to the main direction when the wedge-like dies of the pressing tool are being displaced in the main direction. This embodiment of the method according to the invention achieves very precise calibration of the end regions of a profile blank configured as a hollow-chamber profile.

According to a first advantageous embodiment of the invention, provision is made for a profile blank composed of an extruded aluminum alloy to be used. Materials of this kind have proven to be advantageous in vehicle construction on account of the low weight and the energy-related advantages associated therewith during the operation of the motor vehicle.

In order that no abrasion occurs on the profile blank and on the pressing tool or such abrasion is minimized during the plastic deformation or the calibration of the profile blank inside the pressing tool, provision is made according to a particularly advantageous embodiment of the invention for a lubricant to be applied between the contact surfaces of the pressing tool and of the profile blank that make contact during the compression or plastic deformation. This avoids or substantially minimizes abrasion caused by friction. In this case, the lubricant used can be both a separate lubricant, which is applied to the profile blank prior to the calibration, and a coating applied to contact surfaces of the profile tool.

According to another advantageous embodiment of the invention, it is provided that during the plastic deformation of the at least one plate-like element, overcalibration is performed which compensates for an elastic spring-back action of the element. In this way, the spring-back material property which is inherent to the respective profile blanks is taken into account during the plastic deformation by an elastic return deformation, with the result that the calibration can be performed in a very precise manner. This makes it possible to calibrate profile blanks correspondingly, such that only very small compensation tolerances occur during the subsequent joining to further components.

According to a further concept of the invention, it is provided that the profile blank has at least two different surface portions and oppositely situated surfaces, which define the different wall thicknesses. Such a profile blank can be plastically deformed in a simple manner in the main and secondary directions or in a transverse and a vertical direction by the method according to the invention, it being possible for an aforementioned spring-back action to occur. Taking account of the spring-back action, it is possible to calibrate such a profile blank in a very exact manner, such that simple subsequent and exact joining to further components is made possible. Profiles produced in this way can be used for example as flange plates for bumper systems of a motor vehicle.

According to another concept of the invention, it is provided that the profile blank used is a hollow-chamber profile with at least one hollow chamber. The at least one hollow chamber of such a profile blank in this case contains a plurality of—in particular but not necessarily plate-like—elements which are plastically deformed by the method described above, as a result of which calibration of the whole at least one hollow chamber of the profile blank, and thus of the profile blank itself, is made possible. This makes it possible to perform very exact calibration of hollow chambers of profile blanks or of such profile blanks in a simple manner, without requiring expensive and complex tools for the widening of the hollow chamber or needing to use machining methods for the calibration. Advantageously, a floating mandrel is used in this case as tool in the interior of the at least one hollow chamber, the walls of the individual plate-like elements of the hollow chamber coming to lie on said floating mandrel during the calibration or compression. In this case, this floating mandrel is worked in a very exact manner, since it represents or specifies substantially the calibrated shape of the hollow chamber in the interior thereof.

It is particularly advantageous if a profile blank with at least one hollow chamber is used, said hollow chamber having a polygonal, in particular rectangular profile cross section. Profiles of this kind frequently find use in automotive engineering and the further processing thereof is integrated in a large number of processes during the production of a motor vehicle.

When using profile blanks with at least one hollow chamber, it has proven to be advantageous for the pressing tool used to be a pressing tool with at least one—in particular solid or else hollow—inner tool, in particular in the form of a floating mandrel, which is introduced preferably at least 50 mm into the end region of the at least one hollow chamber of the profile blank prior to the compression. In this way, the end regions of the hollow chamber which are intended for subsequent joining to further components are correspondingly calibrated. Calibration of other regions of the hollow chamber is not necessary for joining purposes and can therefore be omitted. In this way, a method which is particularly advantageous both from an economical and ecological standpoint is provided, since calibration only takes place in the regions of the hollow chamber that require it and also no complex tools are required therefor.

Furthermore, it has proven to be more expedient for both the height and the width of the end region of the hollow-chamber profile blank to decrease by at least 0.2%, in particular by between 0.3% and 5%, during the calibration or during the plastic deformation. Here, it is particularly advantageous that the profile blank can be produced with corresponding tolerances in a simple manner and can be adjusted in the calibration method to the dimensions required for subsequent joining to further components. Here, the springback can also be taken into consideration as a material property in a simple manner during the production of the profile blank, such that very exact production of the profile blank and very exact calibration of same is made possible. In this case, it is particularly advantageous if the wall thickness of the hollow chamber remains unchanged during the calibration. As a result, the wall thicknesses of the hollow chamber both in the case of the profile blank and in the case of the calibrated profile are identical.

Furthermore, protection is sought for a profile which emerges from at least one profile blank of flat or plate-like configuration. In this case, it is also possible for a plurality of profile blanks to be combined or joined together and subsequently calibrated in accordance with the invention. By way of example, reference is made here only to welded aluminum strip material, which is calibrated in accordance with the invention after being separated into profile blanks.

Furthermore, however, protection is also sought for a hollow-chamber profile with at least one open end region, the hollow-chamber profile having at least one hollow chamber extending over at least part of its total longitudinal extent.

Finally, protection is also intended to be sought for a pressing tool for calibration of the aforementioned profile blanks in accordance with one of the methods described above.

BRIEF DESCRIPTION OF THE DRAWINGS

Further aims, advantages, features and application possibilities of the present invention emerge from the following description of exemplary embodiments with reference to the drawings. Here, all the features described and/or illustrated form, on their own or in any desired expedient combination, the subject matter of the present invention, also irrespective of how they are summarized in the claims or how they relate back to preceding claims.

In the figures:

FIG. 1, FIGS. 3 to 5 show individual method steps of a method according to the invention for calibration of a profile blank as per FIG. 1 using a pressing tool as per FIG. 2, FIG. 6, FIGS. 8 to 12 show an illustration of individual method steps for calibration of a profile blank to form a profile as per FIG. 6 using a pressing tool as per FIG. 7, in each case with a detail illustration.

DETAILED DESCRIPTION

Figure 1:
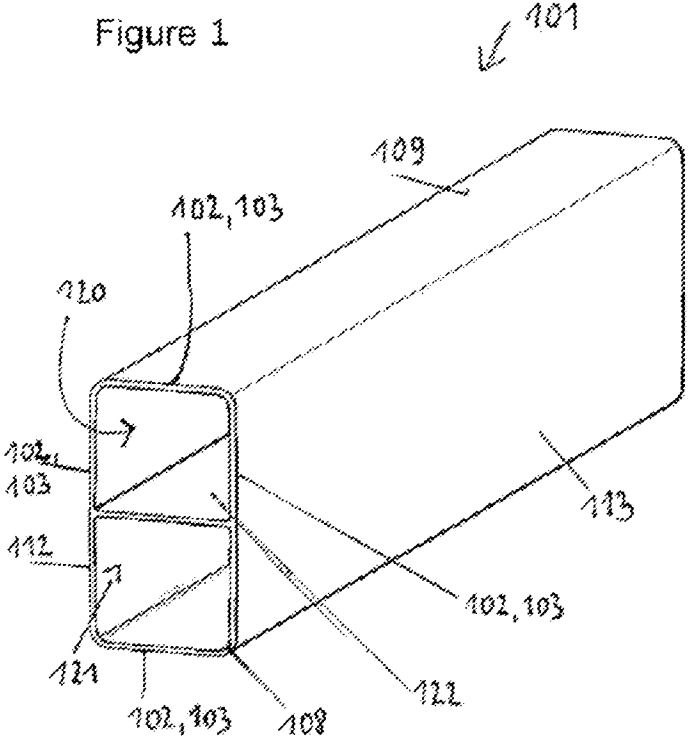
FIG. 1 shows a first exemplary embodiment of a profile blank for production of a profile which is calibrated in accordance with the invention.

In FIG. 1, a first exemplary embodiment of a profile blank 101 for production of a profile according to the invention is now illustrated. Here, the profile blank 101 is configured as a two-chamber hollow profile with hollow chambers 120 and 121 which are arranged one on top of the other and which are separated from one another by a partition 122. The two-chamber hollow profile of the profile blank 101 has in this case a lower surface 108 and an upper surface 109 and a left-hand surface 112 and a right-hand surface 113. In this case, these surfaces 108, 109, 112 and 113 belong to a respective planar element 103 configured as a solid wall 102.

Figure 2:
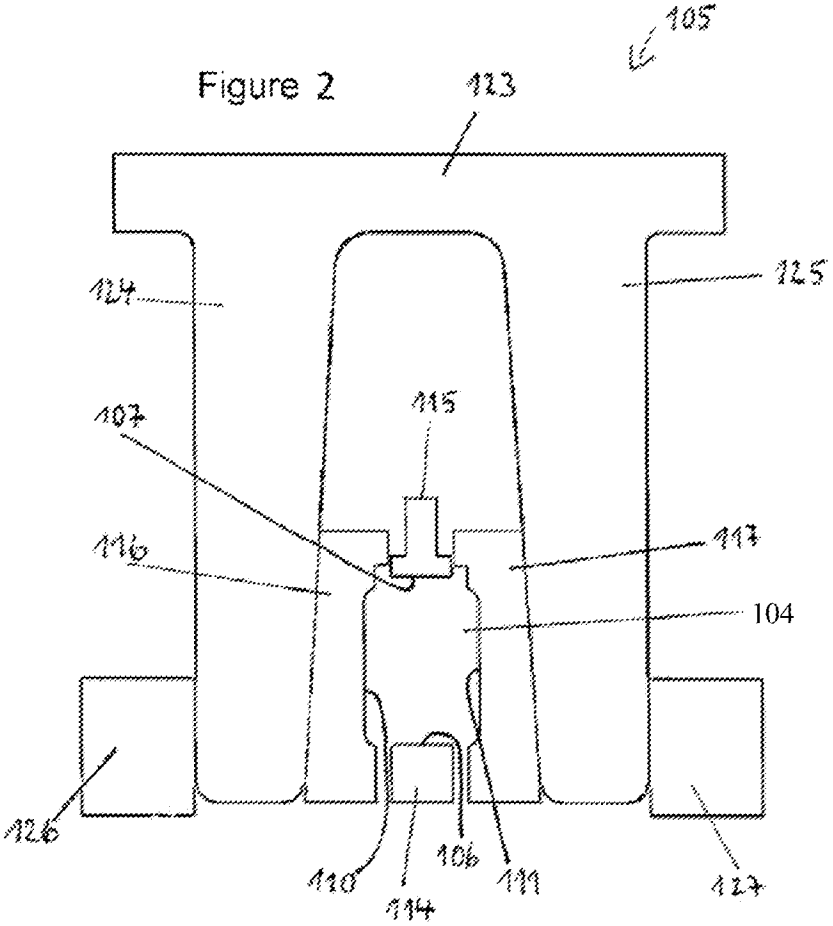
FIG. 2 shows an exemplary embodiment of a pressing tool according to the invention for calibration of the profile blank as per
Figure 6:
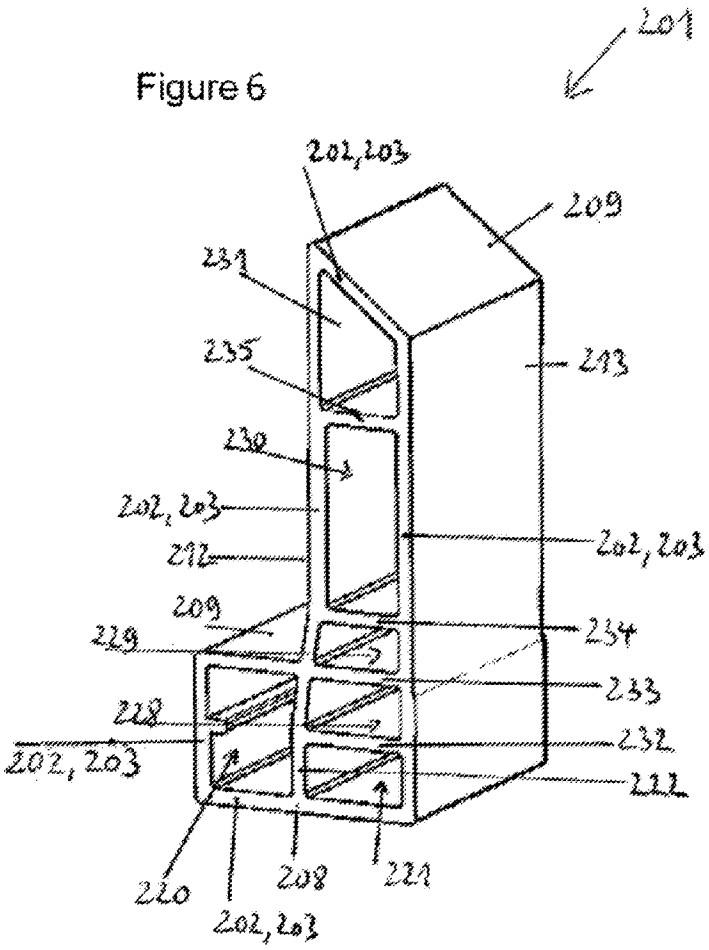
FIG. 6 shows a second exemplary embodiment of a profile blank for production of a profile which is calibrated in accordance with the invention.

In FIG. 2, a pressing tool 105 according to the invention is now illustrated, by means of which a profile blank 1 which is configured as a two-chamber hollow profile as per FIG. 6 can be calibrated. Here, all the elements, with the exception of the floating mandrels provided for the hollow chambers 120 and 121, are illustrated. First of all, these are a lower die 114, an upper die 115 and a left-hand die 116 and a right-hand die 117. The upper die 115 and the lower die 114 can be displaced in relation to one another for example via a hydraulic system which is not illustrated here. In the present case, the left-hand die 116 and the right-hand die 117 are of slightly wedge-like configuration, so that limbs 124 and 125 of a drive element 123 that are also of wedge-like configuration can be displaced in relation to one another so as to be supported on supporting elements 126 and 127. The profile blank 101 as per FIG. 6 for the calibration is inserted into the cavity 104 arranged between the dies 114 to 117. Here, the dies 114 to 117 again have surfaces 106, 107, 110 and 111 which, during the calibration, contact the surfaces 108, 109 and 112 and 113 of the profile blank 101.

Figure 3:
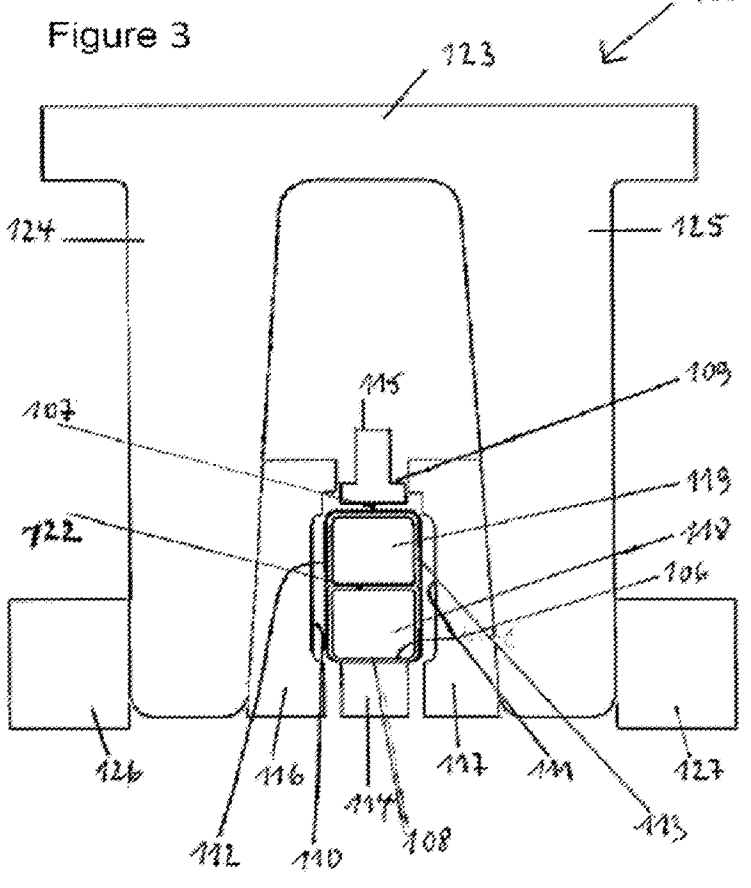

In FIG. 3, the profile blank 101 inserted into the cavity 104 of the pressing tool 105 is now illustrated. In this illustration, the pressing tool 105 is also in its open position, the floating mandrels 118 and 119 mentioned above having already been inserted into the hollow chambers 120 and 121. These floating mandrels 118 and 119 are configured as solid inner tools and have an outer contour which corresponds to the inner contour of the hollow chambers 120 and 121 to be calibrated of the profile which is finally produced from the calibrated profile blank 101. The surface 108 of the profile blank 101 is in this case already in contact with the surface 106 of the lower die 114. Between the other surfaces 112, 113 and 109 of the profile blank 101, there is also a gap relative to the surfaces 110, 111 and 107 of the dies 115, 116 and 117.

Figure 4:
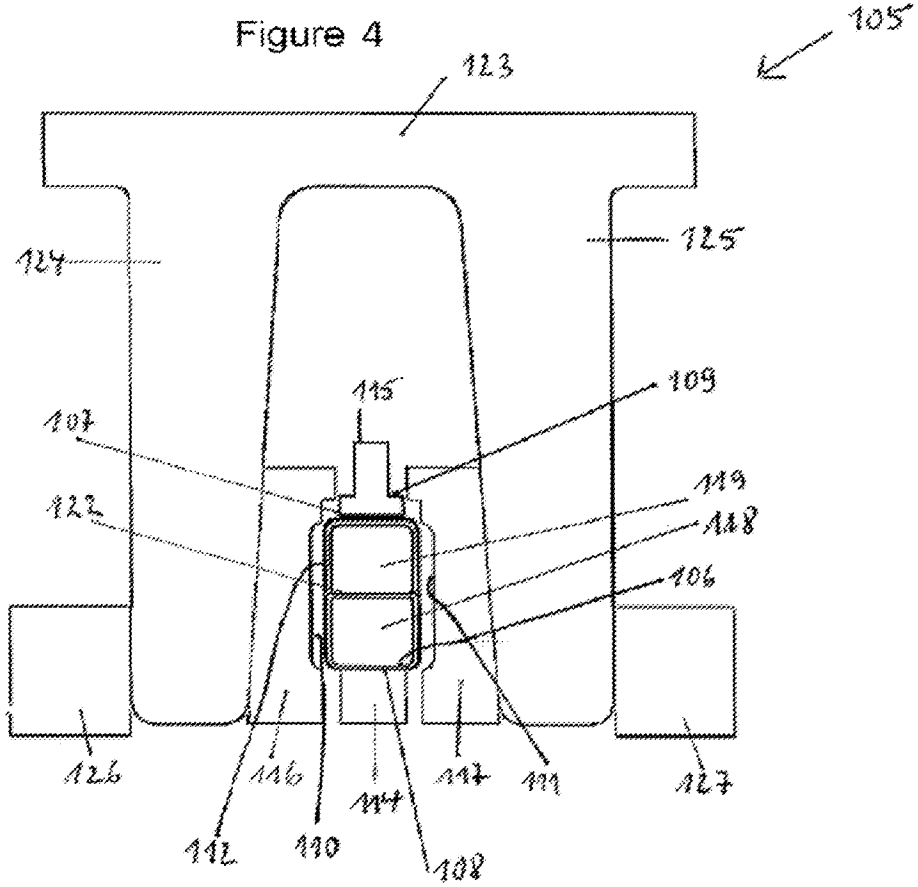

As is now illustrated in FIG. 4, the upper die 115 is displaced toward the lower die 114 of the pressing tool 105. In this case, the surface 107 of the upper die 115 now comes to lie against the surface 109 of the profile blank 101, and during the further displacement of the dies 115 and 114 in relation to one another, the walls of the profile blank 101 that comprise the surfaces 112 and 113 are compressed, these walls being both deformed and subjected to bending. The compression is effected in this case in such a way that the floating mandrels 118 and 119 now strike against the walls of the profile blank 101 that comprise the surfaces 106 and 107 and come into abutment there, while the profile blank 101 is further plastically deformed.

Figure 5:
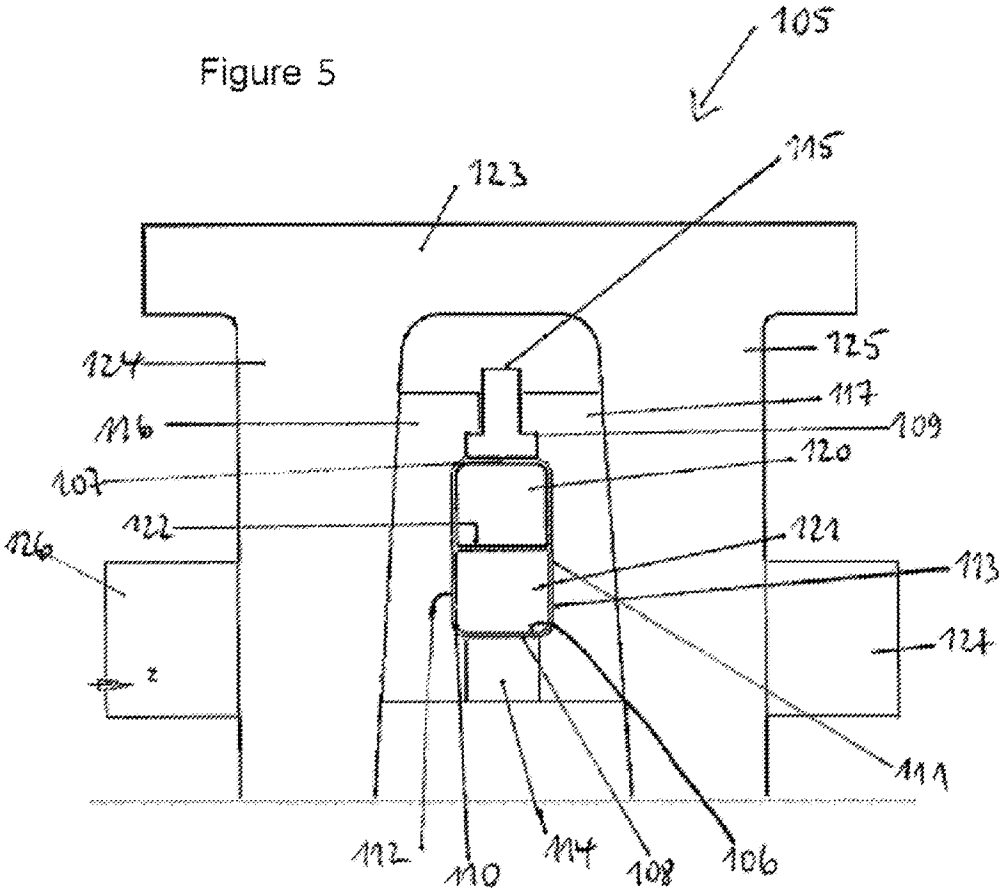

In FIG. 5, the final method step of the pressing operation or compression operation with overcalibration of the profile blank 101 is now illustrated. Here, the left-hand die 116 and the right-hand die 117 have now been displaced in relation to one another by the drive element 123 and the limbs 124 and 125 thereof, along with the mating elements 126 and 127, in such a way that the gap between the walls 110 and 111 of the dies 116 and 117 and the walls 112 and 113 of the profile blank 109 disappears again, and here the profile blank is plastically deformed further so as to eliminate the previously generated bending and is thereby overcalibrated. After the profile blank 101 has been removed from the cavity 104 after the opening of the pressing tool 105, this overcalibration is eliminated as a result of the spring-back property which is inherent to the material, and therefore the finally calibrated profile is produced. It should also be noted that the wall thickness of the profile blank 101 does not change during the calibration thereof. The thickness of the walls of the profile blank corresponds to the thickness of the wall thickness of the calibrated profile. The profile which has now been calibrated in this way can then be supplied for the further use thereof.

FIG. 6 now shows a third exemplary embodiment of a profile blank, which is intended to be calibrated by the method according to the invention. The profile blank 201 of FIG. 6 is a multi-chamber profile, which is configured in a very complex manner with six different hollow chambers 220, 221, 228, 229, 230, 231. In this case, the individual hollow chambers are separated from one another by partitions 221, 232, 233, 234, 235. The multi-chamber hollow profile of the profile blank 201 has in this case a lower surface 208 and an upper surface 209 and a left-hand surface 212 and a right-hand surface 213. In this case, these surfaces 208, 209, 212 and 213 belong to a respective planar element 203 configured as a solid wall 202. Calibration by means of the common internal high pressure method would be difficult on account of the complex tool design. However, simple calibration can be achieved by means of the calibration method according to the invention.

Figure 7:
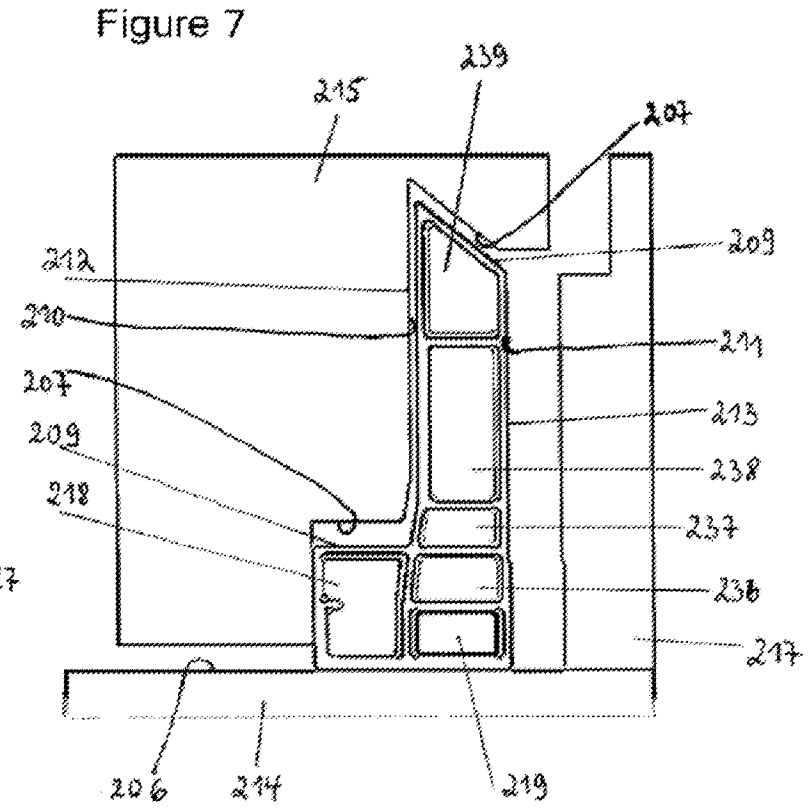
FIG. 7 shows an exemplary embodiment of a tool according to the invention for calibration of a profile blank to form a profile as per

The pressing tool 205, with which the profile blank 201 of FIG. 6 is calibrated, is illustrated substantially in FIG. 7, the profile blank 201 having already been inserted into the cavity 204 of the pressing tool 205.

Figure 8:
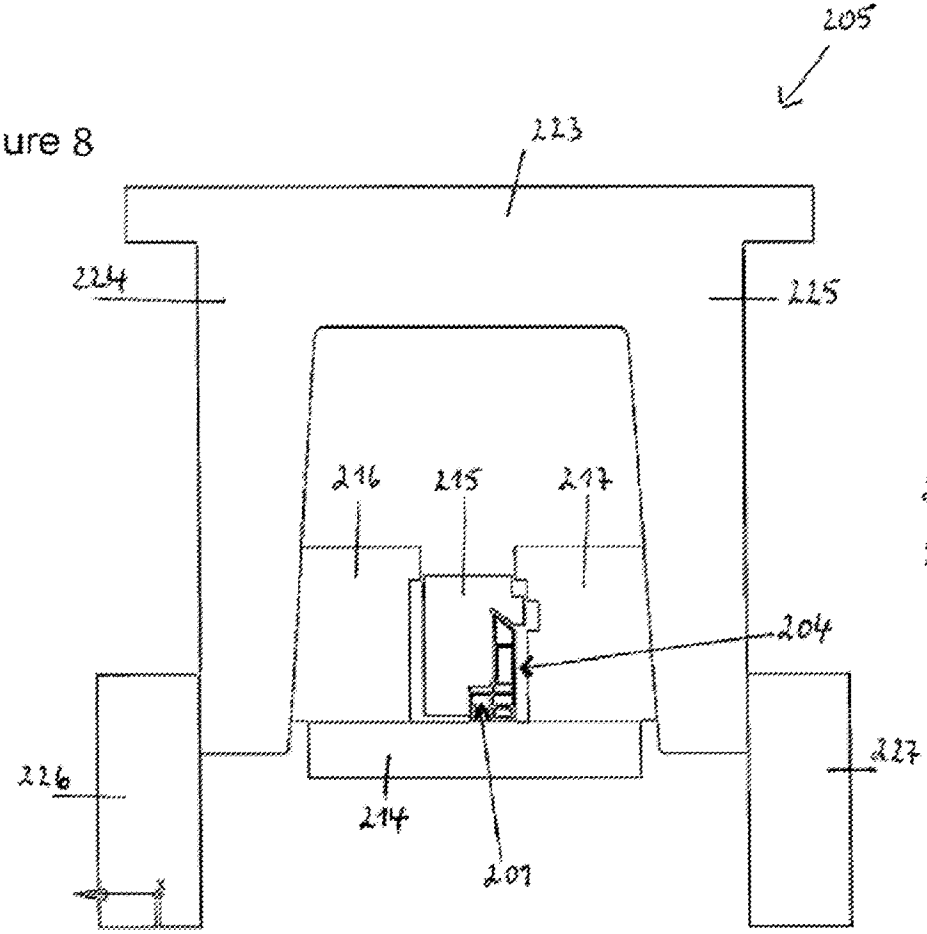

The construction of the pressing tool 205 corresponds substantially to that of the pressing tool 105 of FIGS. 2 to 5, merely the upper die 215 and the left-hand and the right-hand die 216 and 217 having been adapted to the geometry of the profile blank 201 or of the die 215. For the six hollow spaces 220, 221, 228, 229, 230, 231 of the profile blank 201 used here, use is made of six different floating mandrels 218, 219, 236, 237, 238 and 239 which are inserted into these hollow spaces 220, 221, 228, 229, 230, 231 during the calibration. A detail illustration of the profile blank 201 inserted into the pressing tool 205 is illustrated in FIG. 8.

Figure 10:
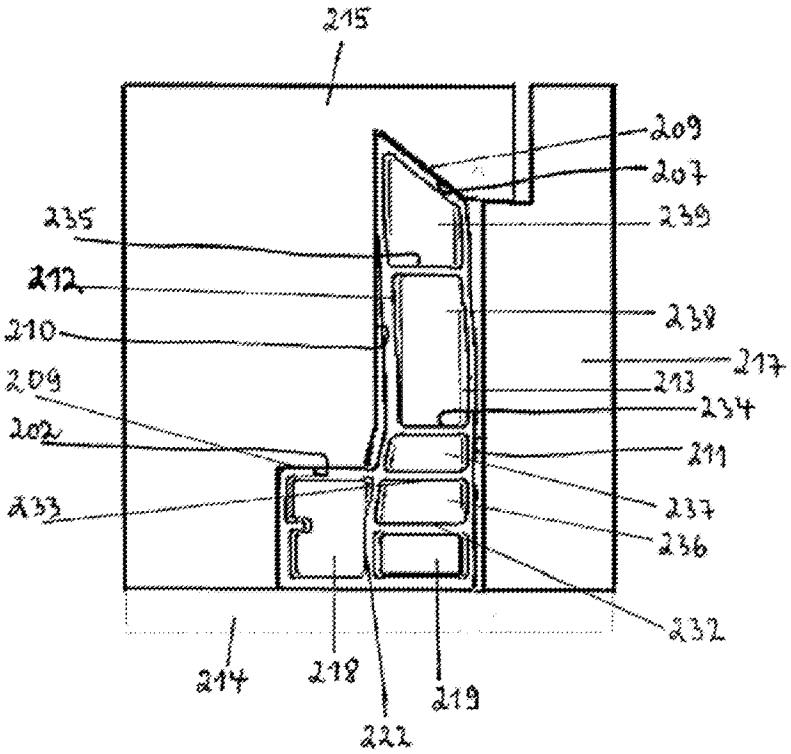
Figure 9:
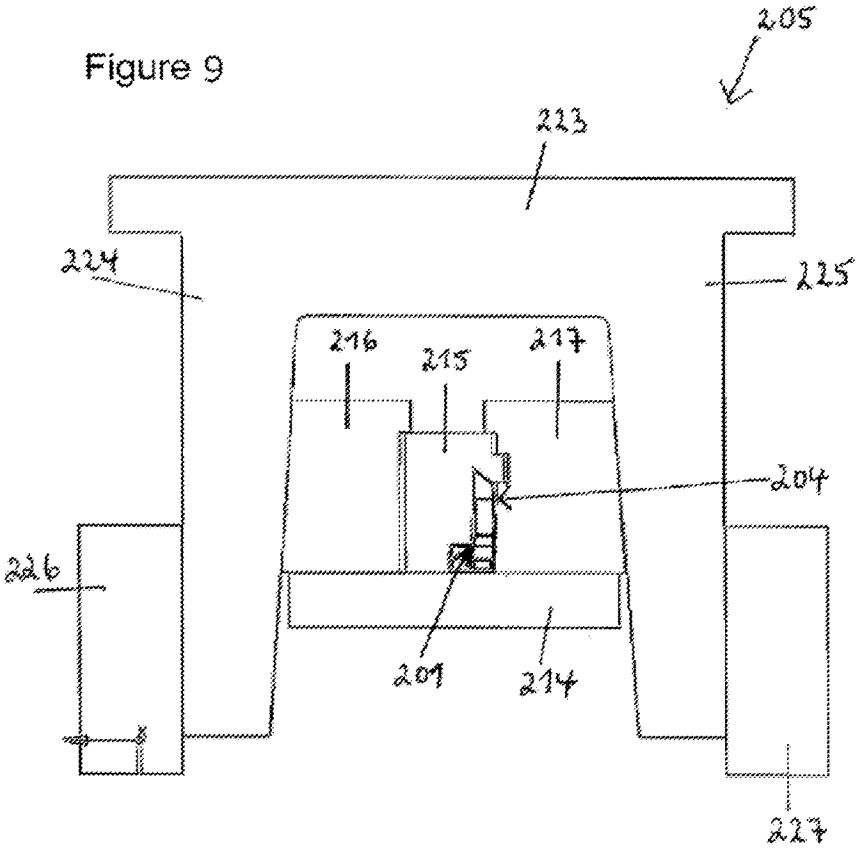

As is now illustrated in FIG. 9 and FIG. 10, the upper die 215 is displaced toward the lower die 214 of the pressing tool 205. In this case, the surface 207 of the upper die 215 now comes to lie against the surface 209 of the profile blank 201, and during the further displacement of the dies 215 and 214 in relation to one another, the walls of the profile blank 201 that comprise the surfaces 212 and 213 are compressed, these walls being both plastically deformed and subjected to bending. The compression is effected in this case in such a way that the floating mandrels 218, 219, 236, 237, 238 and 239 now strike against the walls of the profile blank 201 that comprise the surfaces 208 and 209 and come into abutment there, while the profile blank 201 is further plastically deformed.

Figure 12:
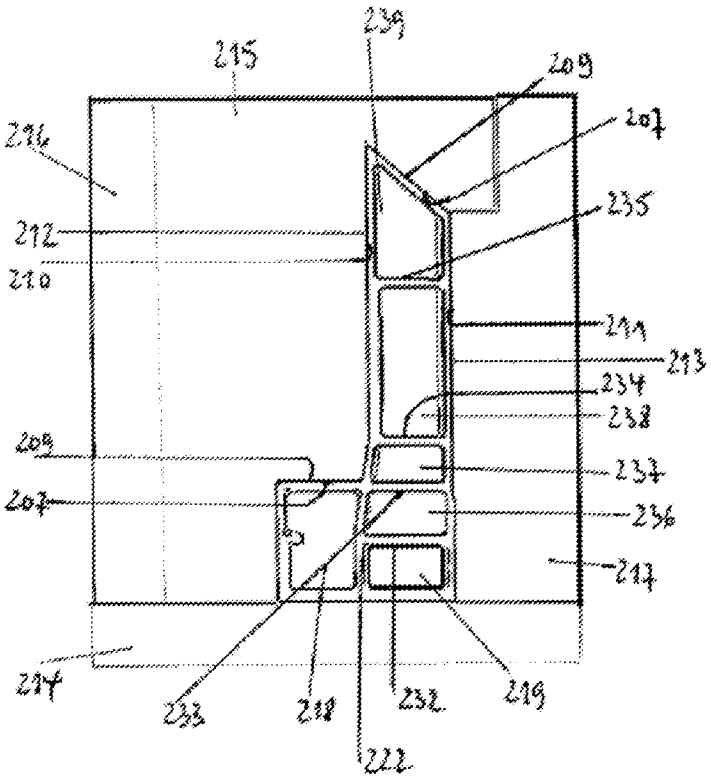
Figure 11:
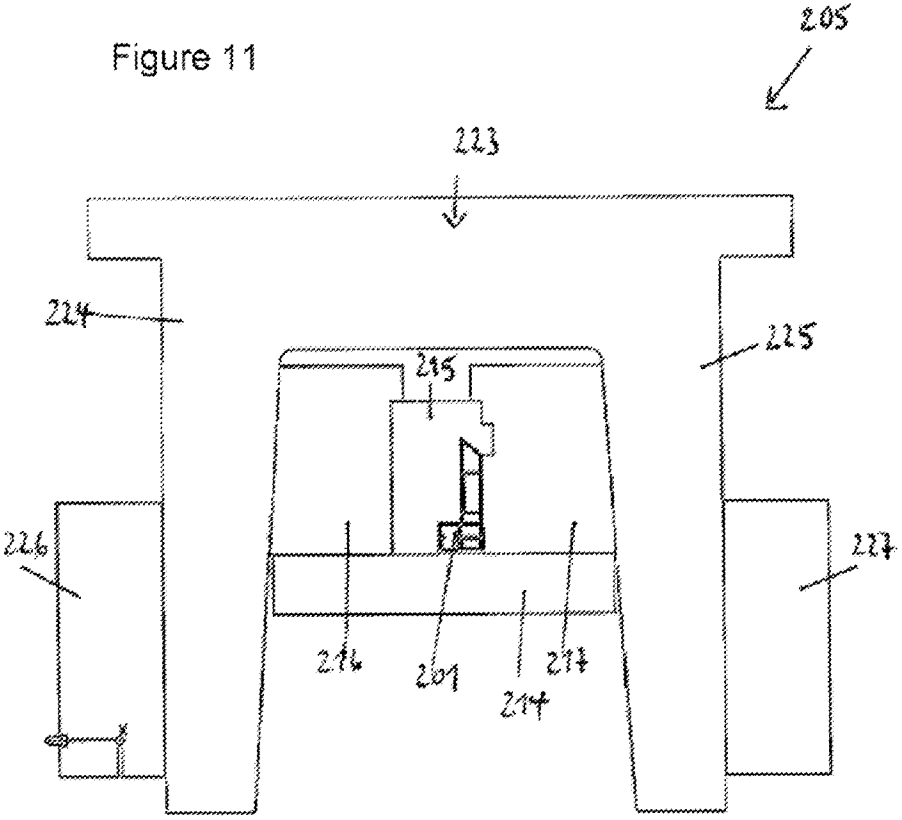

In FIGS. 11 and 12, the final method step of the pressing operation or compression operation with overcalibration of the profile blank 201 is now illustrated. Here, the left-hand die 216 and the right-hand die 217 have now been displaced in relation to one another by the drive element 223 and the limbs 224 and 225 thereof and the mating elements 226 and 227 in such a way that the gap between the walls 210 and 211 of the dies 216 and 217 and the walls 212 and 213 of the profile blank 209 disappears again, and here the profile blank 201 is plastically deformed further so as to eliminate the previously generated bending and is thereby overcalibrated. After the profile blank 201 has been removed from the cavity 204 after the opening of the pressing tool 205, this overcalibration is eliminated as a result of the spring-back property which is inherent to the material, and therefore the finally calibrated profile is produced. It should also be noted that the wall thickness of the profile blank 201 does not change during the calibration thereof. The thickness of the walls of the profile blank corresponds to the thickness of the wall thickness of the calibrated profile. The profile which has now been calibrated in this way can then be supplied for the further use thereof.

LIST OF REFERENCE DESIGNATIONS

101 Profile blank
102 Wall
103 Element
104 Cavity
105 Pressing tool
106 Surface
107 Surface
108 Surface
109 Surface
110 Surface
111 Surface
112 Surface
113 Surface
114 Die
115 Die
116 Die
117 Die
118 Mandrel
119 Mandrel
120 Hollow chamber
121 Hollow chamber
122 Partition
123 Drive element

124 Limb
125 Limb
126 Supporting element
127 Supporting element
201 Profile blank
202 Wall
203 Element
204 Cavity
205 Pressing tool
206 Surface
207 Surface
208 Surface
209 Surface
210 Surface
211 Surface
212 Surface
213 Surface
214 Die
215 Die
216 Die
217 Die
218 Mandrel
219 Mandrel
220 Hollow chamber
221 Hollow chamber
222 Partition
223 Drive element
224 Limb
225 Limb
226 Mating element
227 Mating element
228 Hollow chamber
229 Hollow chamber
230 Hollow chamber
231 Hollow chamber
232 Partition
233 Partition
234 Partition
235 Partition
236 Mandrel
237 Mandrel
238 Mandrel
239 Mandrel

What is claimed is:

1. A method for calibrating a metal profile blank which is configured as a hollow-chamber profile and which has at least one solid wall, comprising:

a) providing the metal profile blank which is configured as a hollow-chamber profile including at least one hollow chamber and which has at least one element with a longitudinal extent, a transverse extent and a vertical extent;

b) inserting at least one end region of the element of the profile blank into a cavity of an open pressing tool;

c) closing the pressing tool in such a way that surfaces of the pressing tool are displaced in a main closing direction perpendicular to the longitudinal extent of the profile blank until the surfaces of the pressing tool come to lie against a first pair of surfaces of the profile blank, which are situated opposite one another at a distance, of the at least one end region of the element of the profile blank to be calibrated;

d) closing the pressing tool further in the main direction, the further closing of the pressing tool having the effect that the at least one end region of the element of the profile blank is deformed and the element of the profile blank is bent;

e) closing the pressing tool in a secondary direction perpendicular to the main direction and to the longitudinal extent of the profile blank until a second set of surfaces of the pressing tool come to lie against a second pair of surfaces of the at least one end region of the element of the profile blank to be calibrated, wherein wedge-shaped limbs of a drive element of the pressing tool come into engagement with wedge-shaped dies of the pressing tool and the wedge-shaped limbs are supported on supporting or mating elements, and wherein a floating mandrel is inserted into the at least one hollow chamber of the profile blank;

f) closing the pressing tool further in the secondary direction, the moving of the wedge-shaped limbs of the drive element of the pressing tool against the wedge-shaped dies of the pressing tool having the effect that the profile blank is subjected to plastic deformation, generated as a result of compression in the secondary direction, in the main and secondary direction so as to reduce or eliminate the bending generated in step d), wherein the element of the profile blank is subjected to bending in the secondary direction perpendicular to the main direction;

g) opening the pressing tool; and h) removing the profile blank from the open pressing tool.

2. The method of claim 1, wherein the profile blank composed of an extruded aluminum alloy is used.

3. The method of claim 1, wherein a lubricant is applied between at least one of the surfaces of the pressing tool and the first pair of surfaces of the profile blank and the second set of surfaces of the pressing tool and the second pair of surfaces of the profile blank.

4. The method of claim 1, wherein during the plastic deformation of the at least one element, overcalibration is performed which compensates for an elastic spring-back action of the element.

5. The method of claim 1, wherein the element is flat or plate-shaped with at least two different surface portions of oppositely situated surfaces, which define different wall thicknesses.

6. The method of claim 1, wherein the at least one hollow chamber includes a hollow chamber that has a polygonal profile cross section.

7. The method of claim 1, wherein the floating mandrel is introduced at least 50 mm into the end region of the at least one hollow chamber of the profile blank prior to the compression.

8. The method of claim 1, wherein both the height and the width of the end region of the hollow-chamber profile blank decreases by at least 0.2% during the calibration.

9. The method of claim 1, wherein the pressing tool comprises at least one additional inner tool.

* * * * *